US010741962B2

(12) United States Patent
Münch

(10) Patent No.: US 10,741,962 B2
(45) Date of Patent: Aug. 11, 2020

(54) CONTACT DEVICE

(71) Applicant: Beckhoff Automation GmbH, Verl (DE)

(72) Inventor: Nicole Rita Münch, Ochsenfurt (DE)

(73) Assignee: Beckhoff Automation GmbH, Verl (DE)

( * ) Notice: Subject to any disclaimer, the term of this patent is extended or adjusted under 35 U.S.C. 154(b) by 0 days.

(21) Appl. No.: 16/802,945

(22) Filed: Feb. 27, 2020

(65) Prior Publication Data

US 2020/0194923 A1 Jun. 18, 2020

Related U.S. Application Data

(63) Continuation of application No. PCT/EP2018/073005, filed on Aug. 27, 2018.

(30) Foreign Application Priority Data

Aug. 31, 2017 (DE) ..... 10 2017 120 059

(51) Int. Cl.
*H01R 13/639* (2006.01)
*H01R 13/506* (2006.01)
(Continued)

(52) U.S. Cl.
CPC ..... *H01R 13/506* (2013.01); *H01R 13/508* (2013.01); *H01R 13/5202* (2013.01); *H01R 13/5841* (2013.01); *H01R 13/622* (2013.01); *H01R 13/639* (2013.01); *H01R 24/545* (2013.01)

(58) Field of Classification Search
CPC ..... H01R 13/622; H01R 13/6278
See application file for complete search history.

(56) References Cited

U.S. PATENT DOCUMENTS 4,820,184 A * 4/1989 Brandes ..... H01R 13/639 439/321
5,085,479 A * 2/1992 Taylor ..... E21B 31/20 294/86.17

(Continued)

FOREIGN PATENT DOCUMENTS

EP 2728677 A1 5/2014
EP 3089284 A1 11/2016
EP 10 2013 007 899 A1 11/2017

*Primary Examiner* — Tho D Ta
(74) *Attorney, Agent, or Firm* — Dorsey & Whitney LLP

(57) ABSTRACT

A contact device comprising a contact housing, a base and a locking device. The base delimits a base interior. The contact housing engages with the base interior. The locking device comprises a locking structure and a locking pin at an outer housing circumferential side of the contact housing. The locking structure comprises a face spline and an unlocking section adjoining the face spline in an axial direction, the unlocking section extending around the contact housing in sections in the circumferential direction in the shape of a groove, the locking pin connected to the base and protrudes into the base interior. The contact housing may be slid between a first axial position and a second axial position in an axial direction relative to the base. In the first axial position the locking pin engages with the face spline. In the second axial position the locking pin engages with the unlocking section.

20 Claims, 11 Drawing Sheets

(51) Int. Cl.

| | |
|---|---|
| ***H01R 13/508*** | (2006.01) |
| ***H01R 13/52*** | (2006.01) |
| ***H01R 24/54*** | (2011.01) |
| ***H01R 13/58*** | (2006.01) |
| ***H01R 13/622*** | (2006.01) |

(56) References Cited

U.S. PATENT DOCUMENTS

| | | | | |
|---|---|---|---|---|
| 9,666,973 | B1 | 5/2017 | Strahl | |
| 2006/0079109 | A1* | 4/2006 | Castleman | H01R 13/633<br>439/312 |
| 2018/0083384 | A1* | 3/2018 | Burns | H01R 13/622 |

* cited by examiner

A-A

B-B

A-A

CONTACT DEVICE

CROSS REFERENCE TO RELATED APPLICATIONS

This patent application claims the priority of International Application No. PCT/EP2018/073005 filed 27 Aug. 2018 and German patent application DE 10 2017 120 059.2, entitled KONTAKTEINRICHTUNG, filed on 31 Aug. 2017, each of which is hereby incorporated by reference in the entirety and for all purposes.

FIELD

The present invention relates to a contact device which comprises a contact housing, a base and a locking device. The contact housing engages with a base interior of the base and may be rotated with respect to the base. The locking device prevents unwanted rotation of the contact housing with regard to the base.

BACKGROUND

EP 3 089 284 A1 discloses a contact device in form of an angled plug having an angled connector housing. A flange sleeve grips the connector housing in the region of a first connector-housing section at its circumferential side, wherein the flange sleeve is fastened to the first connector-housing section by an axial retaining device acting in the direction of a longitudinal axis of the first connector-housing section. The axial retaining device comprises a radial stop that extends from an inner side of the flange sleeve in a direction of an outer side of the first connector-housing section and comprises a counter bearing which interacts with the first connector-housing section in order to determine the axial position with regard to each other. The axial retaining device comprises a spring element which is arranged in a space between the inner side of the flange sleeve and an outer side of the connector-housing section and is retained in pre-tension between the radial stop and the counter bearing producing a first axial spring force. The counter bearing comprises a locking ring that is engaged with a locking device in a locking groove in the outer side of the first connector-housing section.

If long cables are connected to the connector housing, the cables may resonate and/or induce vibrations into the connector housing. The forces occurring during this process may, under adverse circumstances, lead to the control housing being lifted out of the flange sleeve and thus to irreparable damage at the contact device.

SUMMARY

It is an object of the present invention to provide a particularly ergonomic and at the same time particularly stable rotatable contact device.

EXAMPLES

It was recognized that an improved contact device may be provided by the contact device comprising a contact housing, a base and a locking device. The base delimits a base interior, wherein the contact housing engages with the base interior at least in sections, wherein the locking device comprises a locking structure and at least a locking pin at an outer circumferential housing side of the contact housing, wherein the locking structure comprises a face spline and an unlocking section adjoining the face spline in an axial direction, wherein the unlocking section is embodied in a groove-shape extending around the contact housing at least in sections in a circumferential direction, wherein the locking pin is connected to the base and protrudes into the base interior, wherein the contact housing may be shifted relative to the base between a first axial position and a second axial position in an axial direction, wherein in the first axial position the locking pin engages with the face spline and secures a position of the contact housing with regard to the base in a circumferential direction, wherein in the second axial position the locking pin engages with the unlocking section and the contact housing may be rotated relative to the base around an axis of rotation in the circumferential direction.

This embodiment has the advantage that the contact device is particularly stable. In particular, it is prevented that the contact housing is lifted out of the base in a transverse manner by a transverse force acting in a cross-direction with regard to the axis of rotation. Moreover, the locking of the contact housing in the base is embodied particularly simply and inexpensively.

In a further embodiment, the face spline comprises at least a first tooth and a second tooth, wherein in the circumferential direction the first tooth is arranged at a distance from the second tooth, wherein between the teeth the face spline comprises a bottom land, the locking pin having a pin section, the pin section being arranged in the base interior and comprising a contact surface on a side facing the face spline, wherein in the first axial position the contact surface adjoins the bottom land in sections, or wherein in the first axial position the contact surface is arranged at a distance with regard to the bottom land.

In a further embodiment, the face spline comprises at least a first tooth having a first tooth flank, wherein the locking pin has a pin section, wherein the pin section is arranged in the base interior and comprises a contact surface at a circumferential side on a side facing the face spline, wherein the first tooth flank is at least in sections aligned in an inclined manner with regard to a plane in which the rotational axis extends, or wherein the first tooth flank and the axis of rotation are aligned extending in parallel to each other, wherein in the first axial position the contact surface abuts on the first tooth flank.

In another embodiment, the face spline comprises at least a first tooth having a first tooth flank, wherein the locking pin comprises a pin section, wherein the pin section is arranged in the base interior and comprises a contact surface on the circumferential side on a side facing the first tooth flank, wherein the first tooth flank is at least in sections aligned in an inclined manner with regard to a plane in which the rotational axis extends, or wherein the first tooth flank and the rotational axis are aligned extending in parallel to each other, wherein in the first axial position the contact surface adjoins the first tooth flank.

In a further embodiment, the first tooth flank is aligned in such a way that in interaction with the contact surface, when the contact housing is rotated around the rotational axis relative to the base due to a shifting movement of the first tooth flank, an axial shift of the contact housing from the first axial position to the second axial position is caused at the contact surface. As a result, a user does not have to introduce any additional axial force into the contact housing in order to shift the contact housing relative to the base and to carry out the rotational movement of the contact housing around the rotational axis relative to the base. This is particularly ergonomic in the case of narrow installation space. Moreover, the rotation with regard to the alignment of the first contact housing relative to the base may be carried out particularly quickly.

In another embodiment, the first tooth has a tooth tip and a tooth root. In the axial direction, the unlocking section is at a first axial side delimited by the tooth tip, and the tooth root is arranged at a side of the first tooth facing away from the unlocking section. At a second axial side opposite to the first axial side in the axial direction, the unlocking section is delimited by a groove-side face. Preferably, the groove-side face is arranged in a rotational plane relative to the rotational axis. As a result, the locking structure may be embodied at the contact housing in a particularly compact and simple manner. In particular, the contact housing may thereby be manufactured in a particularly easy and inexpensive manner by a sintering process or by injection molding.

In a further embodiment, the contact surface of the pin section is, with regard to its cross-section, at least in sections embodied in an arch-like manner and/or in a plane and/or as a polygonal shape and/or in a concave and/or convex manner.

In a further embodiment, the second tooth comprises a second tooth flank on a side facing the first tooth, wherein in the first axial position the contact surface is arranged at the first tooth flank and at the second tooth flank.

In a further embodiment, the first tooth flank, the tooth-root surface and the second tooth flank are arranged on a shared arch, in particular on a shared circular path having a center point, wherein the center point is arranged in the unlocking section, or wherein the center point is arranged outside of the unlocking section, preferably on a side of the unlocking section facing away from the face spline. As a result, a particularly simple locking pin and a particularly simple embodiment of the face spline may be provided that may be produced in a simple and inexpensive manner.

In another embodiment, the first tooth flank encloses an angle with the second tooth flank, wherein the angle is a blunt or an acute angle, wherein the angle is in particular within a range of 0° to 170°, in particular in a range of 30° to 90°, wherein the angle is in particular 60°, or wherein the first tooth flank and the second tooth flank are aligned in parallel to each other.

In a further embodiment, the contact device comprises a clamping device. The clamping device is arranged between the base and the contact housing in the base interior, wherein the contact housing may be shifted from the first axial position to the second axial position acting against the clamping device, wherein in the second axial position the clamping device provides an axial force for transferring the contact housing back to the first axial position.

In another embodiment, the clamping device is not tensioned in the first axial position. Alternatively, the clamping device is pre-tensioned in the first axial position and presses the face spline against the contact surface by a further axial force. This ensures that the face spline adjoin the contact surface in the first axial position, as well, and reliably prevents rattling of the contact device due to vibrations.

In another embodiment, the clamping device preferably comprises at least a disc spring and/or a corrugated spring and/or a pressure spring.

On a side facing the base interior, the base comprises a first step and the contact housing comprises a second step arranged on its radial outer side. The clamping device is axially arranged between the first step and the second step, wherein the clamping device is supported by the first step on one side and by the second step on another side. This provides a contact device that is particularly compact in a radial direction and through which a large number of electrical conductors may be guided.

In a further embodiment, the base comprises at least a recess wherein the recess is arranged in an inclined manner to the rotational axis, preferably in a further rotational plane with regard to the rotational axis. The locking pin comprises a further pin section. The further pin section engages with the recess at least in sections, wherein the further pin section is connected to the base preferably in a force fit and/or a form fit and/or a material fit. Preferably, the further pin section is pressed into the recess.

In a further embodiment, the contact device comprises a first radial bearing. The first radial bearing comprises a first radial-bearing surface at an inner circumferential base side of the base axially between a lower base-front side and the locking pin. At the outer circumferential housing side of the contact housing, the radial bearing comprises a second radial-bearing surface embodied correspondingly to the first radial-bearing surface and located axially between a lower front side of the contact housing and the locking structure, wherein the first radial-bearing surface and the second radial-bearing surface are preferably embodied extending cylindrically around the rotational axis, wherein the second radial-bearing surface is supported by the first radial-bearing surface. Thereby, tilting of the contact housing in the base while a force perpendicular to the rotational axis is introduced may be reliably prevented or, respectively, the introduced force from the contact housing may be reliably supported at the base.

In a further embodiment, the contact device comprises a second radial bearing, wherein the second radial bearing is arranged axially opposite to the first radial bearing, wherein the second radial bearing comprises a third radial-bearing surface at the outer circumferential housing side of the contact housing, wherein the second radial bearing comprises, at the inner circumferential base side of the base, a fourth radial-bearing surface arranged axially between an upper base-front side opposite to the lower base-front side and the locking pin, wherein the third radial-bearing surface and the fourth radial-bearing surface are embodied extending around the rotational axis, in a preferably cylindrical manner, wherein the third radial-bearing surface is supported by the fourth radial-bearing surface, wherein the first radial bearing is preferably embodied narrower in the radial direction than the second radial bearing. This embodiment has the advantage that the contact device may be kept compact, particularly in the radial direction. Moreover, a particularly large axial distance between the first radial bearing and the second radial bearing is provided so that a tilting out of the base may be reliably prevented when the force is introduced in a transverse manner to the rotational axis of the contact housing or, respectively, so that the force perpendicular to the rotational axis may be reliably supported from the contact housing at the base via the radial bearings.

In a further embodiment, the contact device comprises a sealing device having at least one sealing element. The sealing element is axially arranged between the locking pin and the lower base-front face. The sealing element is arranged in a radial direction between the base and the contact housing. The sealing element seals off the base interior from its surroundings in a fluidic manner. Preferably, the sealing element has an X-shaped cross-section. As a result, it is reliably prevented that dirt and/or liquids penetrate into the base interior. Furthermore, the seal ensures the possibility of reliably shifting the contact housing with regard to the base between the first axial position and the second axial position. Due to the X-shaped embodiment of the sealing element, the sealing element seals off in a radial as well as in an axial direction. Moreover, twisting of the sealing element when shifting the contact housing between the axial positions is prevented. Furthermore, the X-shaped sealing element exhibits a particularly low frictional behavior.

In a further embodiment, the contact housing has a first housing section and a second housing section connected to the first housing section. The second housing section is at least partially arranged in the base interior and the first housing section is arranged outside of the base interior. The first housing section is arranged in an inclined manner, preferably perpendicularly, with regard to the second housing section. The first housing section and the second housing section connected to each other in a form fit and/or in a force fit and/or in a material fit or they are embodied integrally and in one material piece.

BRIEF DESCRIPTION OF THE DRAWINGS

The invention is explained in greater detail below on the basis of preferred exemplary embodiments with reference to figures, in which.

The same reference symbols can be used for the same features below. Furthermore, for the sake of clarity, provision is made for not all features to always be depicted in all drawings. A placeholder in the form of a geometric object is sometimes used for a group of features, for example.

DETAILED DESCRIPTION

Figure 1:
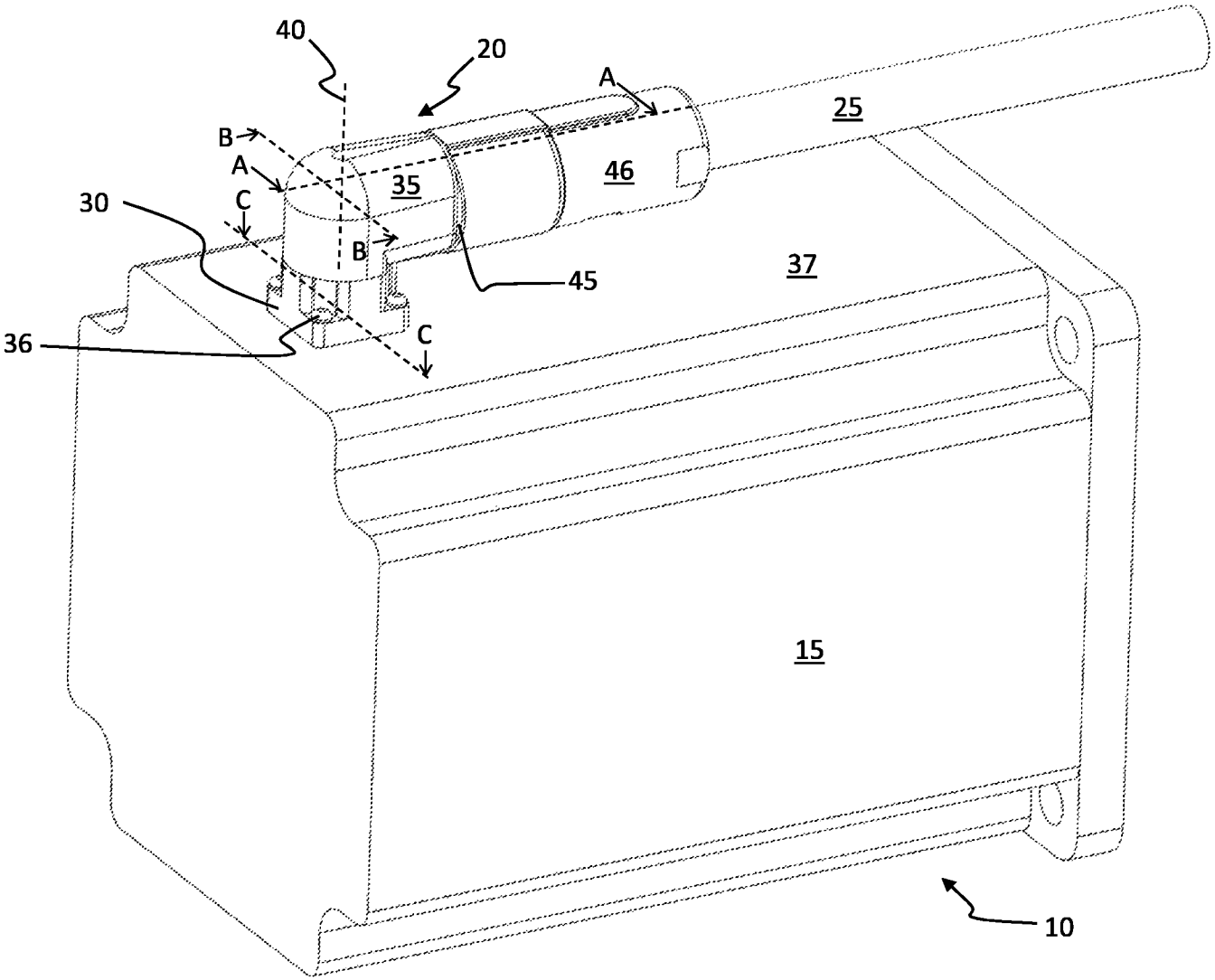
FIG. 1 shows a perspective view of a system.

FIG. 1 shows a perspective view of a system 10 having a first contact device 20 according to a first embodiment.

The system 10 exemplarily comprises a component housing 15, the first contact device 20 and a connecting line 25. Inside of the component housing 15, e.g. an electrical component such as an electrical drive motor may be arranged.

The first contact device 20 comprises a base 30 and a first contact housing 35. The base 30 is fastened to a side face 37 of the component housing 15 by a fastener 36, e.g. screws, on a side of the component housing 15 facing away from the first contact housing 35. The connecting line 25 is guided in parallel to said side face 37.

The first contact housing 35 is connected to the base 30 on a side facing the component housing 15. The first contact housing 35 is arranged around a rotational axis 40 in the base 30 in a pivotable manner. The rotational axis 40 is aligned perpendicularly to the side face 37. On a side facing away from the base 30, the first contact housing 35 has a connecting side 45 to which the first contact housing 35 is connected by the connecting line 25, in particular by a counter plug arranged at the connecting line.

Figure 2:
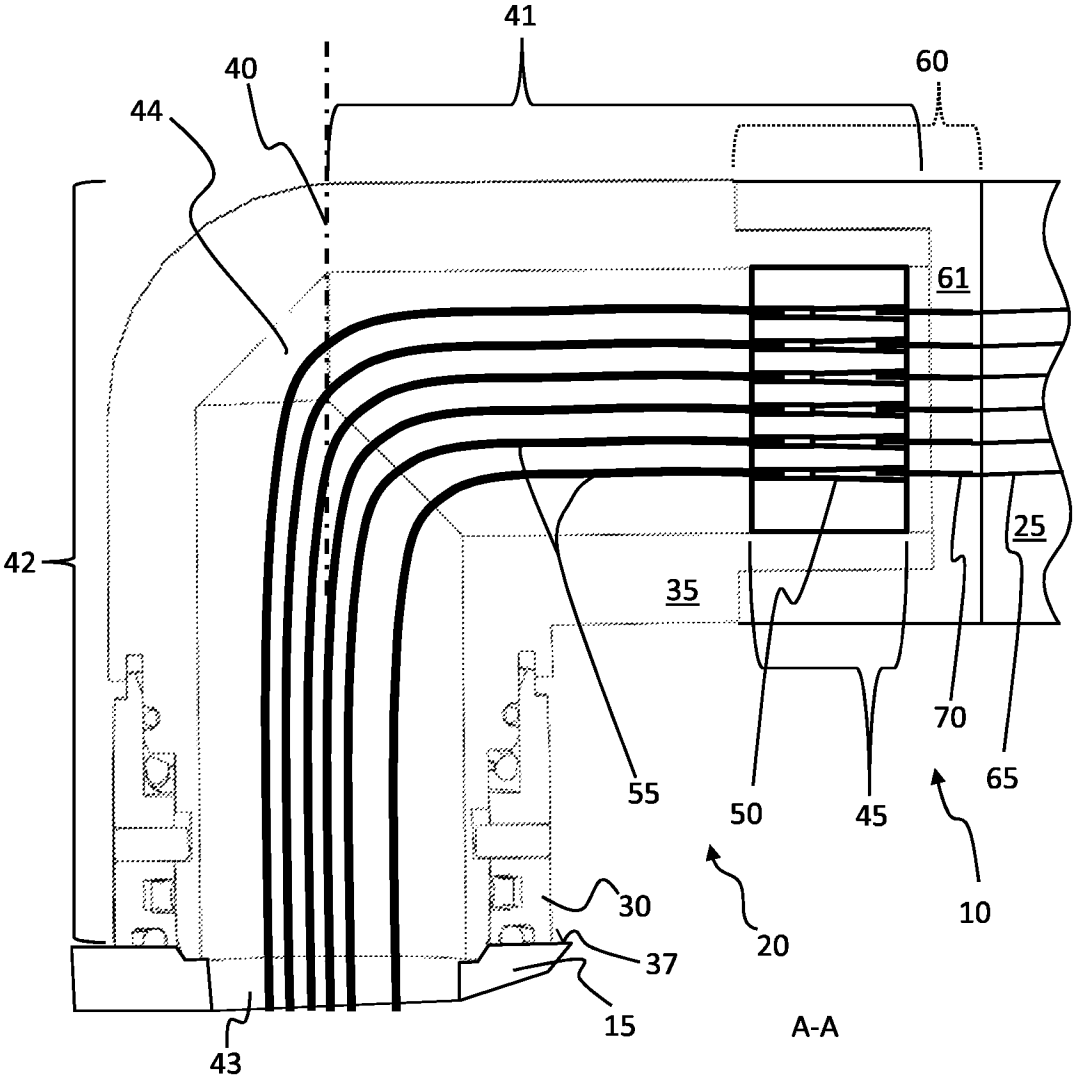
FIG. 2 depicts a detail from a cross-sectional view along a sectional plane A-A shown in FIG. 1 through the system depicted in FIG. 1.

FIG. 2 shows a detail from a sectional view along a sectional plane A-A shown in FIG. 1 cutting through the system 10 of FIG. 1.

The first contact housing 35 is embodied as an angled housing and has an L-shape in the embodiment. The first contact housing 35 comprises a first housing section 41 and a second housing section 42. The first housing section 41 is arranged in parallel to the side face 37 of the component housing 15. The second housing section 42 is aligned perpendicularly to the first housing section 41 and to the side face 37 and connected to the first housing section 41 at one side. At the side facing away from the first housing section 41, the second housing section 42 is connected to the base 30. The component housing 15 comprises a via opening 43. The second housing section 42 leads to the via opening 43 on a side facing away from the first housing section 41.

In the embodiment, the first housing section 41 and essentially the second housing section 42 are embodied as hollow cylinders. The first contact housing 35 is preferably embodied integrally and in one material piece. The first housing section 41 and the second housing section 42 delimit a housing interior 44.

Within the housing interior 44, a plurality of first electrical lines 55 are arranged that are each electrically insulated from each other. The first electrical lines 55 are arranged in the housing interior 44 in such a way that the first electrical lines 55 twist by at least 180° when the first contact housing 35 is rotated around the rotational axis 40 and do not block the rotation of the first contact housing 35 and are not damaged during the rotation. Moreover, the first electrical lines 55 are guided through the via opening 43 into the component housing 15, e.g. to the component.

The first contact device 20 comprises a first contact element 50 at the connecting side 45 for each first electrical line 55, respectively. The first contact element 50 is respectively connected to an electrical line 55. Moreover, the first contact element 50 is fastened in the first contact housing 35 in the first housing section 41.

The connecting line 25 comprises a second contact device 60, e.g. a counter plug 46, and preferably a plurality of second electrical lines 65. The second contact device 60 comprises a second contact housing 61 and one second contact element 70 for each second electrical line 65, respectively. The second contact element 70 is embodied corresponding to the first contact element 50 and establishes an electrical connection to the respectively assigned first contact element 50 in an assembled state of the connecting line 25 at the connecting side 45 of the first contact device 20.

If, e.g., the first contact element 50 is embodied as a sleeve contact as schematically shown in FIG. 2, e.g. the second contact element 70 is embodied as a plug contact engaging with the first contact element 50. As an alternative, the first contact element 50 may be embodied as a plug contact and the second contact element 70 as a sleeve contact. The second contact element 70 is fastened in the second contact housing 61.

In order to mechanically fasten the second contact device 60 to the first contact device 20, the second contact housing 61 e.g. grips around the first housing section 41 at the connecting side 45 in a circumferential direction.

In addition, fastener and/or lock may be provided in order to secure the second contact housing 61 against being unwantedly pulled off from the first contact housing 35.

Figure 3:
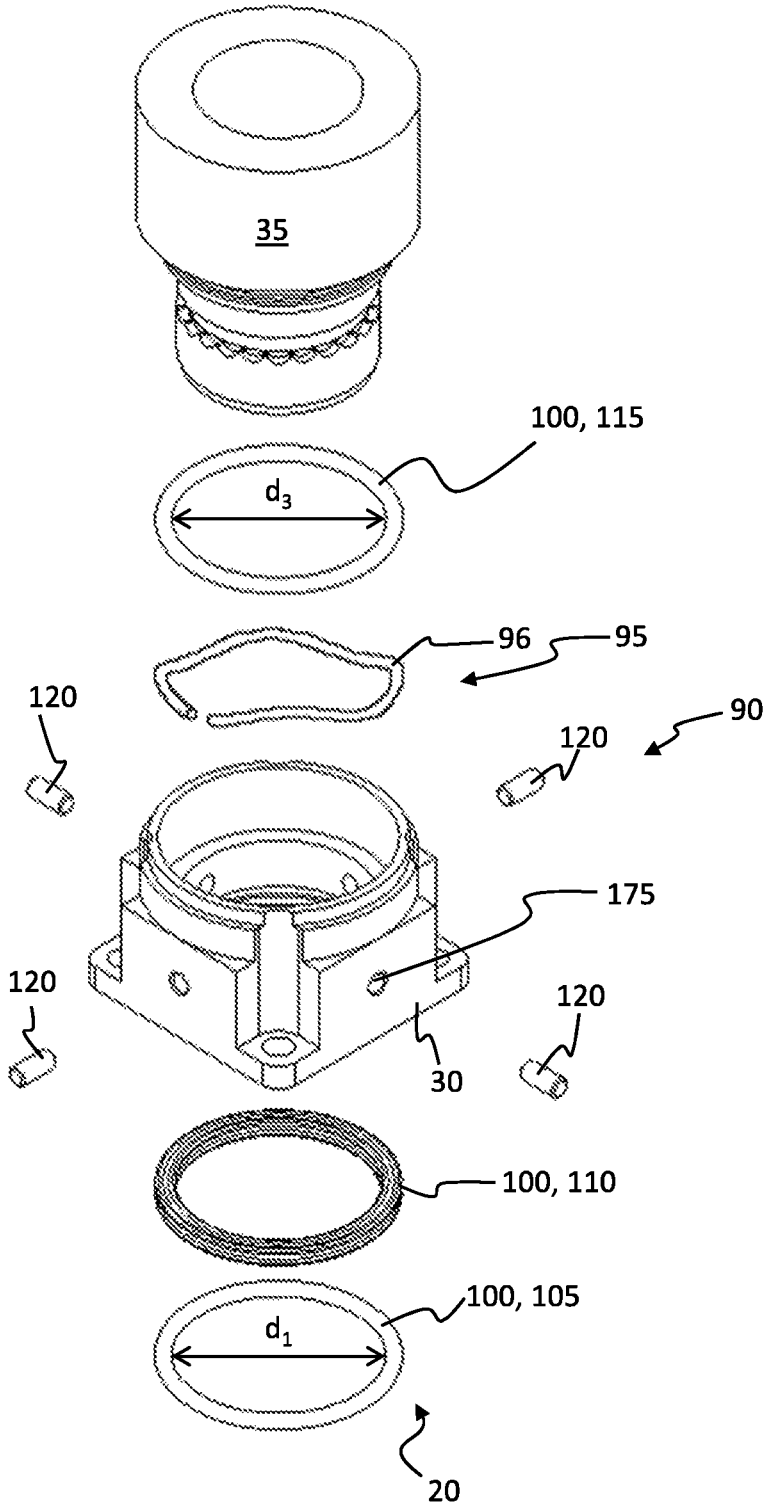
FIG. 3 is an exploded view of the first contact device shown in FIGS. 1 and 2.

FIG. 3 shows an exploded view of the first contact device 20 shown in FIGS. 1 and 2.

In addition to the base 30 and the first contact housing 35 shown in a shortened manner in FIG. 3, the first contact device 20 shows a locking device 90, a clamping device 95 and a sealing device 100. The sealing device 100 comprises a first sealing element 105, a second sealing element 110 and a third sealing element 115.

The first sealing element 105 and the third sealing element 115 are e.g. embodied as an O ring. In this context, e.g. an interior diameter d3 of the third sealing element 115 is larger than an interior diameter dl of the first sealing element 105. The second sealing element 110 preferably comprises an X-shaped cross section. The sealing element 110 may also be embodied differently, e.g. as an O ring. Due to the X-shaped embodiment of the second sealing element 110, the sealing element 110 seals off in a radial direction as well as in an axial direction. Moreover, a twisting of the sealing element 100 is prevented. Furthermore, the X-shaped second sealing element 110 has a particularly favorable frictional behavior.

In the embodiment, the clamping device 95 comprises a corrugated spring 96. The corrugated spring 96 is produced from a rounded material as an open ring. A different embodiment of the corrugated spring 96 is contemplated, as well. Also, in addition or alternatively to the corrugated spring 96, the clamping device 95 may at least comprise a pressure spring and/or a disc spring.

The locking device 90 comprises at least a locking pin 120. In the embodiment, e.g. in FIG. 3, four locking pins 120 are provided. The number of locking pins 120 may be chosen as desired. It is, however, advantageous if at least three locking pins 120 are provided that are arranged e.g. at a regular distance in the circumferential direction in a distributed manner with regard to the rotational axis 40.

Figure 4:
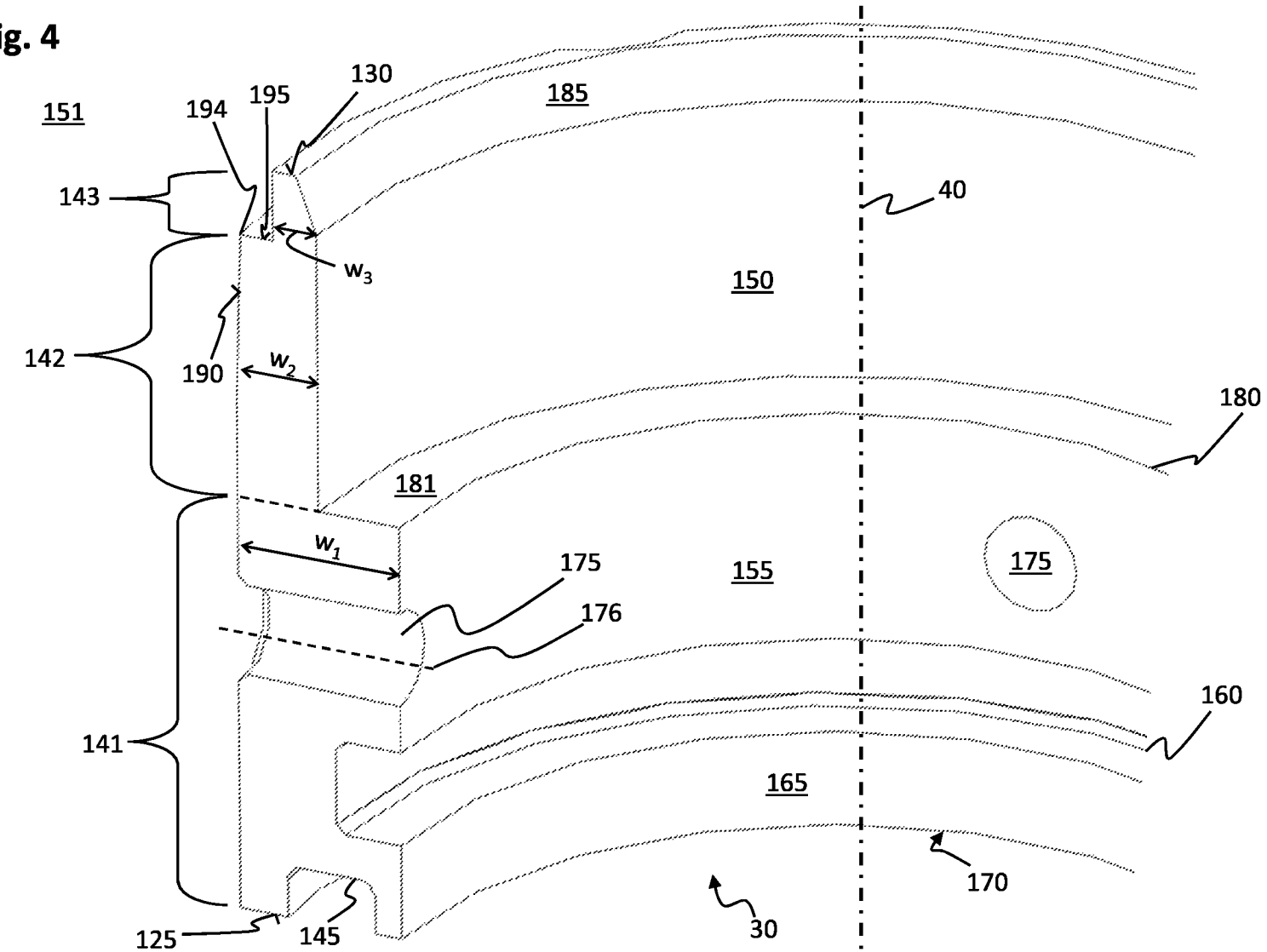
FIG. 4 depicts a detail from a cross-sectional view along the sectional plane A-A shown in FIG. 1 through the base depicted in FIGS. 1 to 3.

FIG. 4 shows a detail of a perspective sectional view along the sectional plane A-A shown in FIG. 1 cutting through the base 30 depicted in FIG. 1.

On its inside, the base 30 is essentially a hollow cylinder extending around the rotational axis 40 and delimiting a base interior 150 on the inner side with regard to its surroundings 151. The base 30 comprises a lower base-front face 125 and an upper base-front side 130 arranged axially opposite with regard to the rotational axis 40. At the lower base-front side 125, a first sealing groove 145 arranged running around a first circular path around the rotational axis 40. With its lower base-front side 125, the base 30 abuts on the side face 37 of the component housing 15. The first sealing groove 145 is open towards the bottom.

In the first sealing groove 145, the first sealing element 105 is arranged wherein the first sealing element seals off the base interior 150 and the housing interior with regard to the surroundings 151.

In an axial direction, the base 30 comprises a first base section 141, a second base section 142 and a third base section 143. The first base section 141 abuts on the lower base-front side 125. The second base section 142 is arranged above, directly abutting on the first base section 141 in an axial direction. In an axial direction above the second base section 142, the third base section 143 is arranged in an abutting manner. The third base section 143 is arranged in an axial direction between the upper base-front side 130 and the second base section 142.

At the first base section 141, a first wall thickness w1 is thicker than a second wall thickness w2 of the second base section 142. A third wall thickness w3 of the third base section 143 is lower than the second wall thickness w2. The third base section 143 is considerably shorter in an axial direction than the first base section 141 and the second base section 142. Moreover, the second base section 142 is shorter in an axial direction than the first base section 141.

At a transition between the first base section 141 and the second base section 142, an inner circumferential base face 155 comprises a first step 180. The first step 180 comprises a first supporting surface 182 that is arranged in a rotational plane extending with regard to the rotational axis 40.

At an inner circumferential base face 155 of the base 30, the first base section 141 comprises a second sealing groove 160. The second sealing groove 160 is open inwardly in direction of the base interior 150 and arranged with a displacement to the lower base-front face 125 in the axial direction. The second sealing groove 160 is embodied extending around the rotational axis 40 on a circular path. In this context, the second sealing groove 160 as well as the first sealing groove 145 e.g. comprises a rectangular cross-section.

Above the second sealing groove 160, the first base section 141 comprises a first recess 175 for each locking pin 120. The first recess 175 is embodied as a bore and comprises a longitudinal recess axis 176 that is arranged in an inclined manner with regard to the rotational axis 40, preferably perpendicularly to the rotational axis 40. If a plurality of locking pins 120 is provided, the longitudinal recess axes 176 may be arranged in a shared rotational plane with regard to the rotational axis 40. The first recesses 175 may be circumferentially arranged in a distributed manner at regular intervals.

At the inner circumferential base face 155 of the first base section 141, the first base section 141 comprises a first radial bearing surface 16 of a first radial bearing 170 between the lower base-front face 125 and the first recess 175. The first radial-bearing surface 165 is in this context e.g. embodied extending around the rotational axis 40 in a cylindrical shape.

At the inner circumferential base face 155 of the third base section 143, a first chamfer 185 is provided. The first chamfer 185 has e.g. an inclination of 60° to 75° with regard to the upper base-front face 130.

An outer circumferential base face 190 of the base 30 is embodied at the first base section 141 extending cylindrically with regard to the rotational axis 40. At the second base section 142, the outer circumferential base face 190 is in sections embodied cylindrically on a side facing the first base section 141 and essentially rectangular at a side facing away from the first base section 142. The outer circumferential base face 190 is embodied cylindrically around the rotational axis 40 at the third base section 143 and displaced radially inwardly with regard to the second base section 142. Thereby, a second step 194 is provided at the outer circumferential base face 190 of the base 30 at the transition between the third base section 143 and the second base section 142. The second step 194 comprises a first step surface 195 extending in a rotational plane with regard to the rotational axis 40 and remains free (in an unassembled state of the base 30) on a side facing the upper front face 130.

Figure 5:
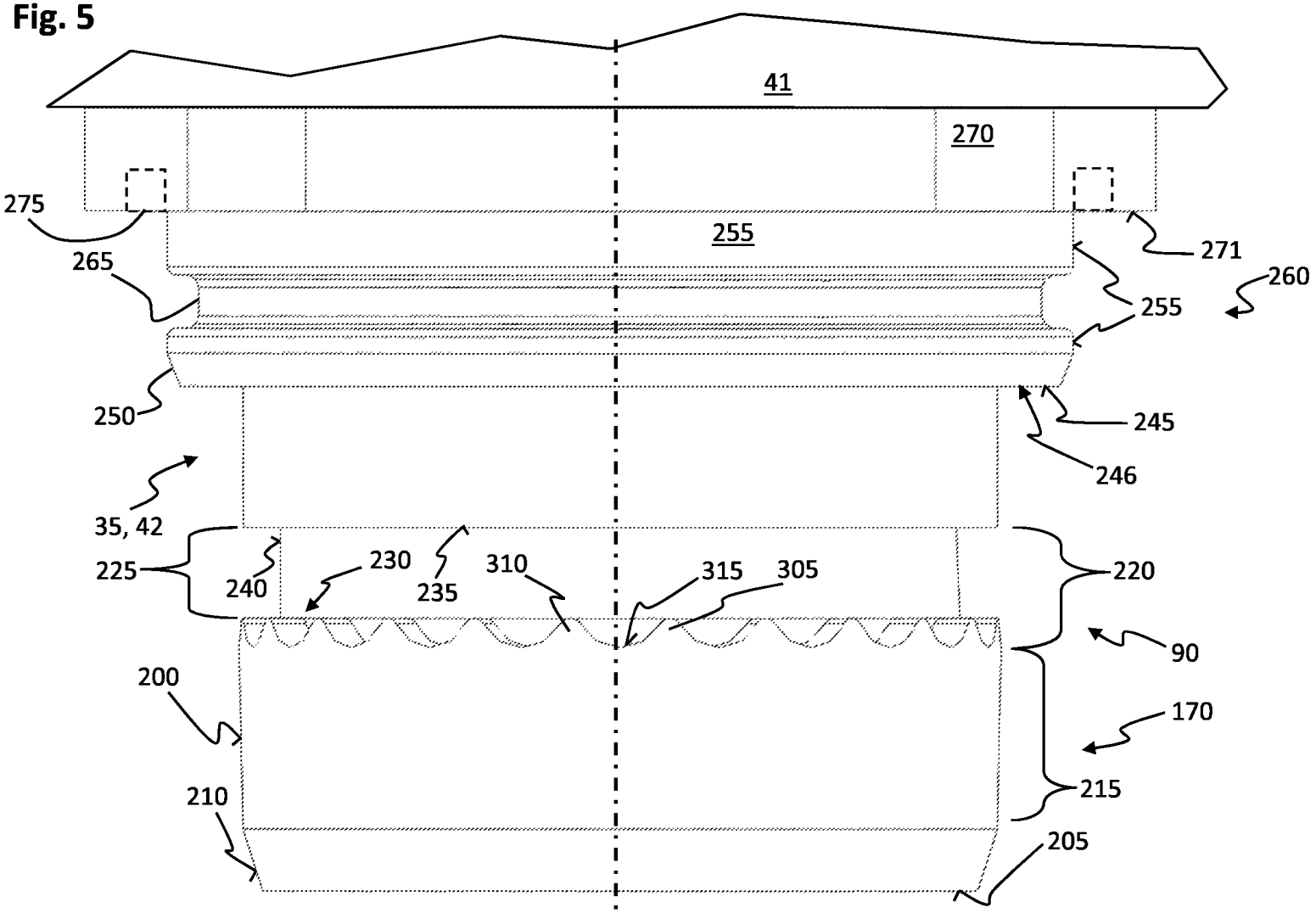
FIG. 5 shows a detail of a lateral view onto the second housing section of the first contact housing.

FIG. 5 shows a detail from a lateral view of the second housing section 42 of the first contact housing 35.

The second housing section 42 comprises a second chamfer 210 at an outer circumferential housing face 200 abutting on a lower housing-front face 205 of the first contact housing 35. The second chamfer 210 comprises e.g. an inclination of 60° to 75° with regard to the lower housing-front face 205.

The first radial bearing 170 comprises a second radial-bearing surface 215 abutting axially on the second chamfer 210. The second radial-bearing surface 215 is embodied correspondingly to the first radial-bearing surface of the base. The second radial-bearing surface 210 extends cylindrically around the rotational axis 40.

Abutting on the upper side of the second radial-bearing surface 215, the locking device 90 comprises a locking structure 220 at the outer circumferential housing face 200. The locking structure 220 comprises an unlocking section 225 and a face spline 230. The face spline 230 is arranged in an axial direction between the second radial-bearing surface 215 and the unlocking section 225.

The unlocking section 225 is shaped like a groove and is delimited in an axial direction with regard to the rotational axis 40 by the face spline 230 on the one side and by a lateral groove face 235 on the other side (a side facing away from the lower housing front face 205). The lateral groove face 235 extends in a rotational plane with regard to the rotational axis 40. A groove root surface 240 of the unlocking section 225 is embodied extending cylindrically around the rotational axis 40. The unlocking section 225 is open radially outwardly.

The face spline 230 comprises at least a first tooth 305 and a second tooth 310, the latter arranged in a displaced manner with regard to the first tooth 305 in a circumferential direction. The number of teeth 305, 301 of the face spline 230 is exemplarily shown in FIG. 5. In the circumferential direction between the first tooth 305 and the second tooth 310, the face spline 230 comprises a bottom land 315.

In an axial direction and displaced with regard to the locking structure 220 on a side facing away from the lower housing front face 205, the second housing section 42 comprises a third step 245. The third step 245 comprises a second supporting surface 246 extending in a rotational plane with regard to the rotational axis 40. The second supporting surface 246 is in FIG. 5 arranged on the side facing the lower housing-front face 205.

In an axial direction abutting on a side facing away from the lower housing front face 205 of the second supporting surface 246, a third chamfer 250 is additionally provided at the third step 245. The third chamfer 250 e.g. has an inclination of 60° to 75° with regard to the second supporting surface 246.

Above the third chamfer 250, a second radial bearing 260 comprises a third radial-bearing surface 255. The third radial bearing surface 255 is cylindrically arranged around the rotational axis 40. Exemplarily, a third sealing groove 265 is provided in the third radial-bearing surface 255. The third sealing groove 265 is opened radially outwardly.

A fourth step 270 adjoins on an upper side of the third radial-bearing surface 255. By the third step 245 and the fourth step 274, the outer circumferential housing face 200 of the first contact housing 35 has a step-like embodiment with increasing diameter in an upwards direction of the first housing section 41 starting from the lower housing-front face 205. The fourth step 270 comprises a second step surface 271 on a side facing the lower housing-front face 205. The second step surface 271 is arranged in a rotational plane extending around the rotational axis 40.

In addition, a second recess 275 is provided in the fourth step 270. The second recess 275 is embodied in a groove shape extending around the rotational axis 40. The second recess 275 is opened towards the lower housing-front face 205 of the first contact housing 35.

Figure 6:
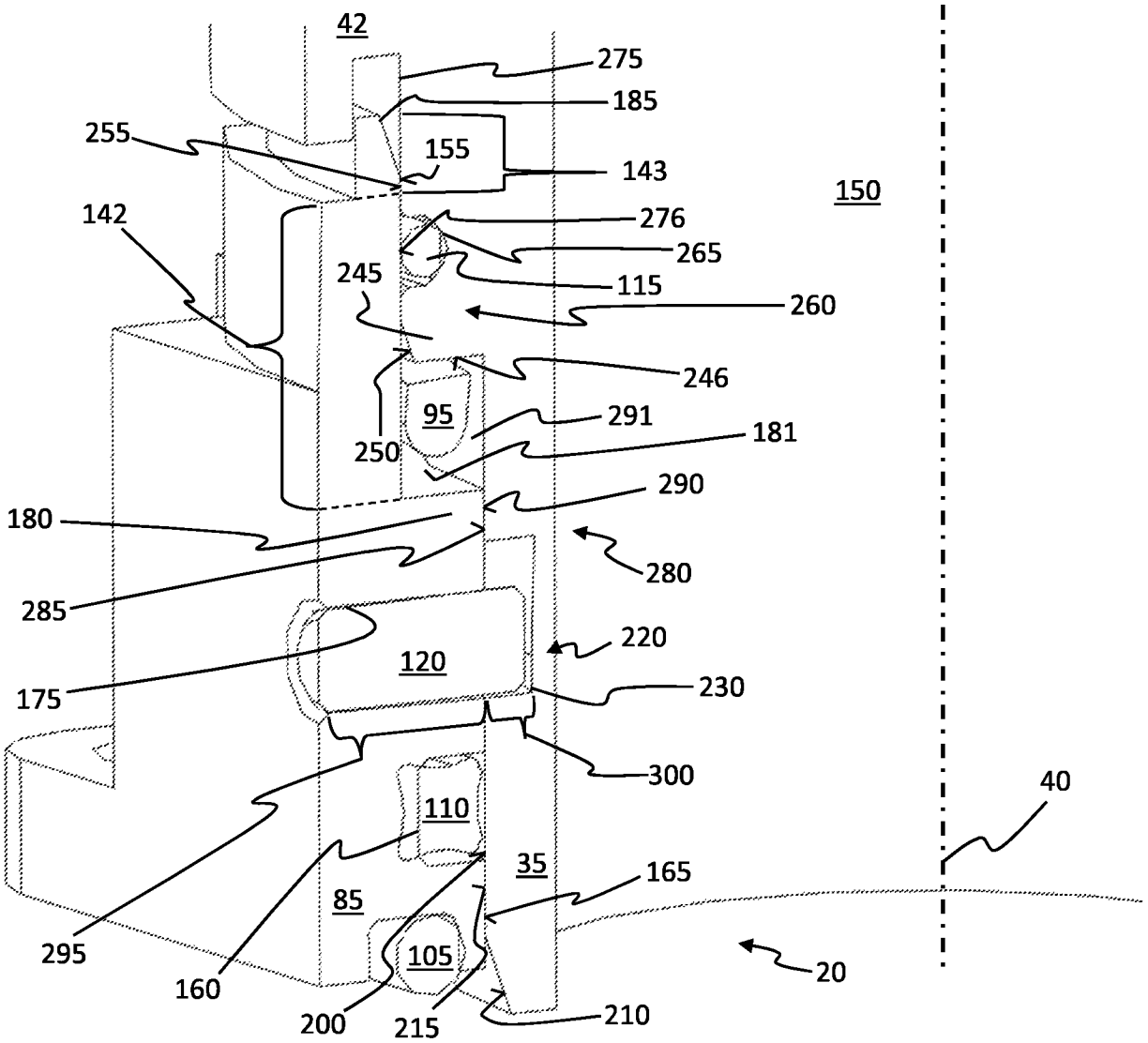
FIG. 6 shows a detail of the sectional view depicted in FIG. 2 along the sectional plane A-A shown in FIG. 1 running through the system.

FIG. 6 shows a detail of a perspective sectional view along the sectional plane A-A shown in FIG. 1 running through the system 10. For clarity reasons, only the first contact device 20 is depicted in FIG. 6.

In FIG. 6, the first contact housing 35 is arranged in a first axial position with regard to the base 30. In the first axial position, the third base section 143 engages with the second recess 275 exclusively in sections. Thereby, the second recess as well as the third base section 143 form a gap seal which prevents dirt particles from penetrating into the base interior 150 independently from the axial position of the first contact housing 35.

The second radial bearing 260 comprises a fourth radial-bearing surface 276 at the inner circumferential base face 155 at the second base section 142 axially between the first step 180 and the first chamfer 185. The fourth radial-bearing surface 276 is embodied cylindrically around the rotational axis 40 corresponding to the third radial-bearing surface 255. The third radial-bearing surface 255 abuts on the fourth radial-bearing surface 276.

The third sealing element 115 is arranged in the third sealing groove 265. The third sealing element 115 abuts on the fourth radial-bearing surface 276 which in sections also serves as a sealing surface. Due to the high manufacturing quality of the fourth radial-bearing surface 276, damage to the third sealing element 115 due to an axial movement of the first contact housing 35 relative to the base 30 is hereby prevented.

In addition, the first contact device 20 may comprise a third radial bearing 280. The third radial bearing 280 comprises a fifth radial-bearing surface 285 and a sixth radial-bearing surface 290. The fifth radial-bearing surface 285 is axially arranged at the outer circumferential housing face 200 between the locking structure 220 and the third step 245. At the inner circumferential base face 155, the sixth radial-bearing surface 290 is arranged. The sixth radial-bearing surface 290 is arranged in an axial direction between the first step 180 and the recesses 175. The sixth radial-bearing surface 290 and the fifth radial-bearing surface 285 are embodied correspondingly to each other and extend cylindrically around the rotational axis 40. The first radial-bearing surface 165 and the sixth radial-bearing surface 290 may serve as a shared radial-bearing surface.

Axially between the first step 180 and the third step 245, the clamping device 95 is arranged in a spring space 291. On the radial outer side, the ring-shaped spring space 291 is delimited by the fourth radial-bearing surface 276 and on the radial inner side by the firth radial-bearing surface 285. Thereby, the clamping device 95 is at an outer side supported at the first supporting surface 181 and at the other side at the second supporting surface 246.

In the second sealing groove 160, the second sealing element 110 is arranged. By arranging the second sealing groove 160 at the first radial-bearing surface 165, the second sealing element 110 abuts on the second radial-bearing surface 215 so that due to the high surface quality of the first radial bearing 170 embodied as a slide bearing, damage to the second sealing element 110 may be prevented.

Furthermore, the second radial-bearing surface 215 abuts on the first radial-bearing surface 165 on both sides of the second sealing groove 160. Due to the radial bearings 170, 260, 280 being embodied as slide bearings and due to the fact that as a result the respectively associated radial-bearing surfaces 165, 215, 255, 276, 285, 290 abut on one another in a planar manner, high forces acting transversely to the rotational axis 40 that might cause the second housing section 42 in the base interior 150 to tilt may reliably be prevented. In particular, prying open or destroying the first contact housing 35 even if strong forces act onto the second housing section 42 perpendicular to the rotational axis 40 is reliably prevented by the radial bearings 170, 260, 280 due to the large axial distance between the radial bearings 170, 260, 280.

By providing the chamfers 185, 210, 250, a particularly easy insertion of the second housing section 42 into the base interior 150 from above in the direction of the component housing is enabled. In particular, the first chamfer 185 prevents excessive squeezing and/or damaging of the third sealing element 115 and the second chamfer 210 prevents excessive squeezing and/or damaging of the second sealing element 110 when axially inserting the second housing section 42 into the base interior 150. Thereby, reliable sealing of the base interior 150 by the second and third sealing element 110, 115 is ensured between the base 30 and the second housing section 42.

Moreover, the arrangement of the locking device 90 axially between the second sealing element 110 and the third sealing element 115 reliably prevents dirt or fluids from penetrating into the component housing 15. In addition, broken component parts, e.g. from the face spline 230, as well as abrasive wear due to wear on the locking device 90 is kept from penetrating into the component housing 15 by the second and third sealing element 110, 115, and hence from possibly damaging the components arranged in the component housing 15.

The locking pin 120 comprises a first pin section 295 and a second pin section 300. The first pin section 295 is connected to the second pin section 300. In the embodiment, the locking pin 120 exemplarily has a cylindrical shape, wherein the outer diameter extends over the entire length of the locking pin 120. In addition, the locking pin 120 may be laterally beveled. The first pin section 295 engages with the first recess 175 of the base 30. In this context, it is advantageous if the first pin section 295 is pressed into the first recess 175. This ensures reliable retaining of the locking pin 120 in the base 30. A different fastening of the locking pin 120 at the base 30 is contemplated, as well; in this manner, the locking pin 120 may be connected to the base 30 in a force fit and/or a form fit and/or a material fit.

The second pin section 300 protrudes into the base interior 150. In the first axial position, as shown in FIG. 6, the second pin section 300 engages with the face spline 230 and secures a position of the first contact housing 35 in circumferential direction with regard to the rotational axis 40.

The above-described system 10 is particularly easy and quick to assemble. In particular, the contact device 20 may also be mounted in a (partially) automated manner. In the following, reference will briefly be made to assembly wherein the order described in the following may of course be varied.

At first, the second sealing element 110 is inserted into the second sealing groove 160. Subsequently thereto, the clamping device is introduced into the base interior 150 from above and deposited on the first supporting surface 181. Moreover, the third sealing element 115 is inserted into the third sealing groove 265. Thereafter, the first contact housing 35 is inserted into the base interior 150 until the unlocking section 225 is arranged at the height of the recesses 175. Then, the locking pins 120 are inserted into the recesses 175 and, if the case may be, glued therein. After this, the first sealing element 105 is inserted in the first sealing groove 105 and the first electrical line 55 is threaded to the electrical drive motor through the via opening. Subsequently thereto, the base 30 is deposited on the side face 37 and fastened to the component housing 15 by the fastener. The electrical line is connected to the first contact element and the first contact element is fastened to the first contact housing 35 at the connecting face.

Figure 7:
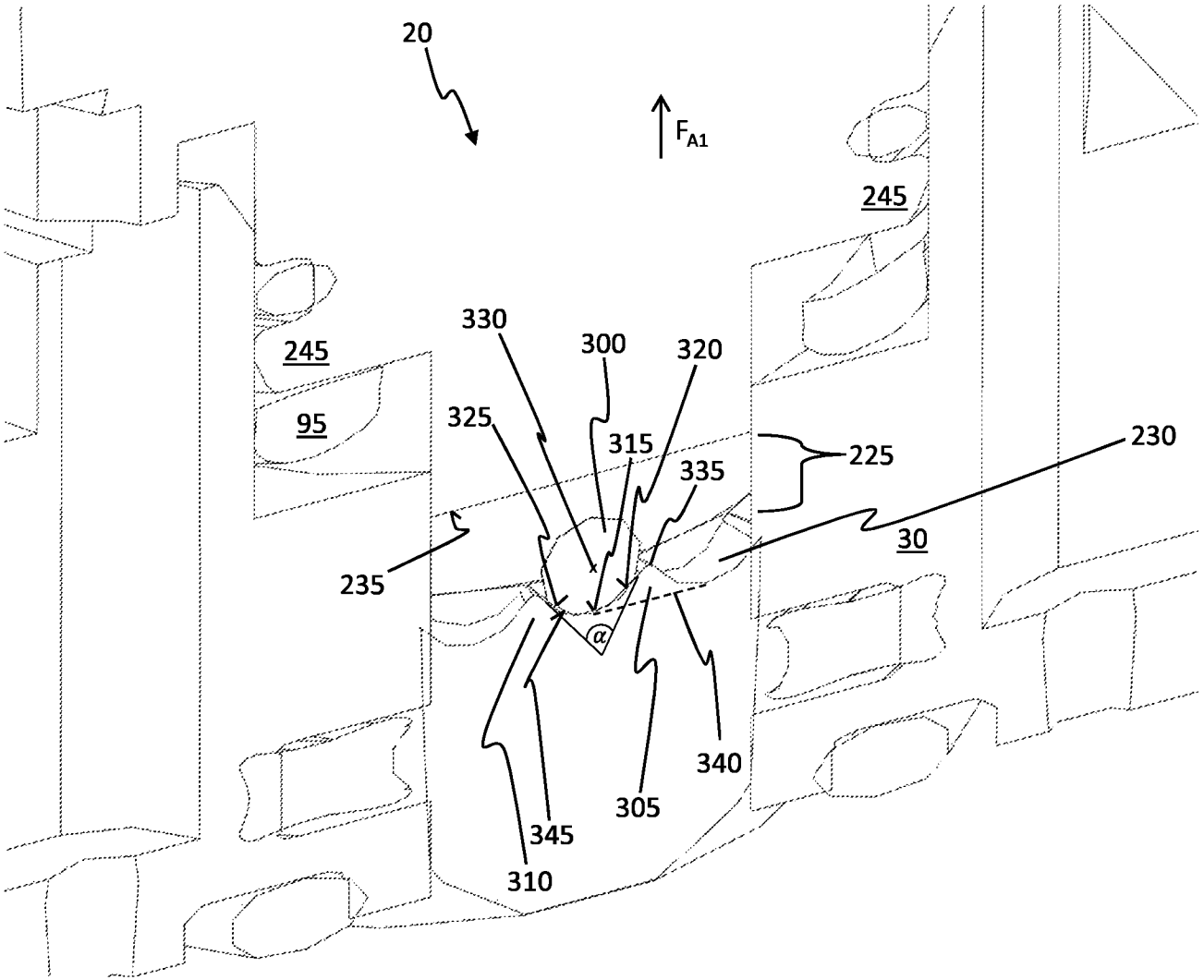
FIG. 7 shows a detail of a sectional view along a sectional plane B-B shown in FIG. 1 running through the first contact device.

FIG. 7 depicts a detail from a sectional view along a sectional plane B-B shown in FIG. 1 cutting through the first contact device 20.

The first tooth 305 comprises a first tooth flank 320 on a side facing the second tooth 310 and the second tooth 310 comprises a second tooth flank 325 on a side facing the first tooth 305. The bottom land 315 connects the first tooth flank 320 to the second tooth flank 325.

The first tooth flank 320 is delimited by a tooth tip 335 and the bottom land 315. In this context, the tooth tip 335 is arranged on a side of the tooth 305, 310 facing the unlocking section 225 and delimits the unlocking section 225 opposite to the groove-side face 235. Each tooth 305, 310 comprises a tooth root 340. The tooth root 340 is arranged on the side of the tooth 305, 310 facing away from the unlocking section 225. The first tooth flank 320 and the second tooth flank 325 are arranged in an inclined manner with regard to the rotational axis 40, in particular with an inclination to a plane through which the rotational axis extends. Alternatively, the first tooth flank 320 and the second tooth flank 325 may be aligned in parallel to each other, wherein each of the tooth flanks 320, 325 are arranged in a plane shared with the rotational axis 40.

It is of particular advantage if the first tooth flank 320, the bottom land 315 and the second tooth flank 325 are arranged on a shared arch, particularly on a shared circular path having a center point 330. A different embodiment is contemplated, as well. The center point 330 may be arranged in an unlocking section 225. Alternatively, the center point 330 may also be located outside of the unlocking section 225, e.g. on a side of the unlocking section facing away from the set of face tooth 230 in an axial direction.

The first tooth flank 320 encloses an angle $\alpha$ with the second tooth flank 325 at the tooth tip 335, respectively. It is particularly advantageous if the angle $\alpha$ is an acute or a blunt angle. It is furthermore advantageous if the angle $\alpha$ is in a range of 0° to 170°, in particular in a range of 30° to 90°. Preferably, the angle is 60°.

The second pin section 300 comprises a contact surface 345 on a side facing the face spline. The contact surface 345 is e.g. cylindrical in shape in the embodiment and embodied corresponding to the first tooth flank 320, the bottom land 315 and the second tooth flank 325.

It is of particular advantage if the unlocking section 225 comprises an axial width in an axial direction between the tooth tip 335 and the groove-side face 235 which corresponds approximately to an axial extension of the second pin section 300 or, in the embodiment, to a diameter of the second pin section 300.

In the first axial position, as shown in FIG. 7, the contact surface 345 abuts on the first tooth flank 320, the second tooth flank 325 and the bottom land 315 so that due to the engagement, a position of the first contact housing 35 relative to the base 30 is determined in a circumferential direction. Moreover, due to the contact surface 345 abutting on the bottom land 315, an unwanted axial movement of the first contact housing 35 with regard to the rotational axis 40 relative to the base 30 is prevented. Alternatively, it is contemplated that the contact surface 345 only exclusively abuts on one of the tooth flanks 320, 325 or only exclusively on the bottom land 315 and is arranged at a distance to the tooth flanks 320, 325.

In the embodiment, the clamping device 95 is exemplarily untensioned in the first axial position. Alternatively, the clamping device 95 may be pre-tensioned in the first axial position. Pre-tensioning has the advantage that if e.g. the contact surface 345 exclusively abuts on only the bottom land 315, a friction fit is generated between the contact surface 345 and the bottom land 315 due to the pre-tensioning and thus, the first contact housing 45 can, in a circumferential direction, only be rotated around the rotational axis 40 after overcoming the friction fit.

If the clamping device 95 is pre-tensioned, the clamping device 95 provides a first axial force $F_{A1}$ in the first axial position. The first axial force $F_{A1}$ is introduced into the first contact housing 35 due to the third step 245. In the embodiment, the first axial force $F_{A1}$ exemplarily acts in an upwards direction. Thereby, the face spline 230 is drawn upwards and pressed to the contact surface 345 with the first axial force $F_{A1}$. This embodiment has the advantage that the first contact housing is in an axial direction arranged without play with regard to the base 30.

Figure 8:
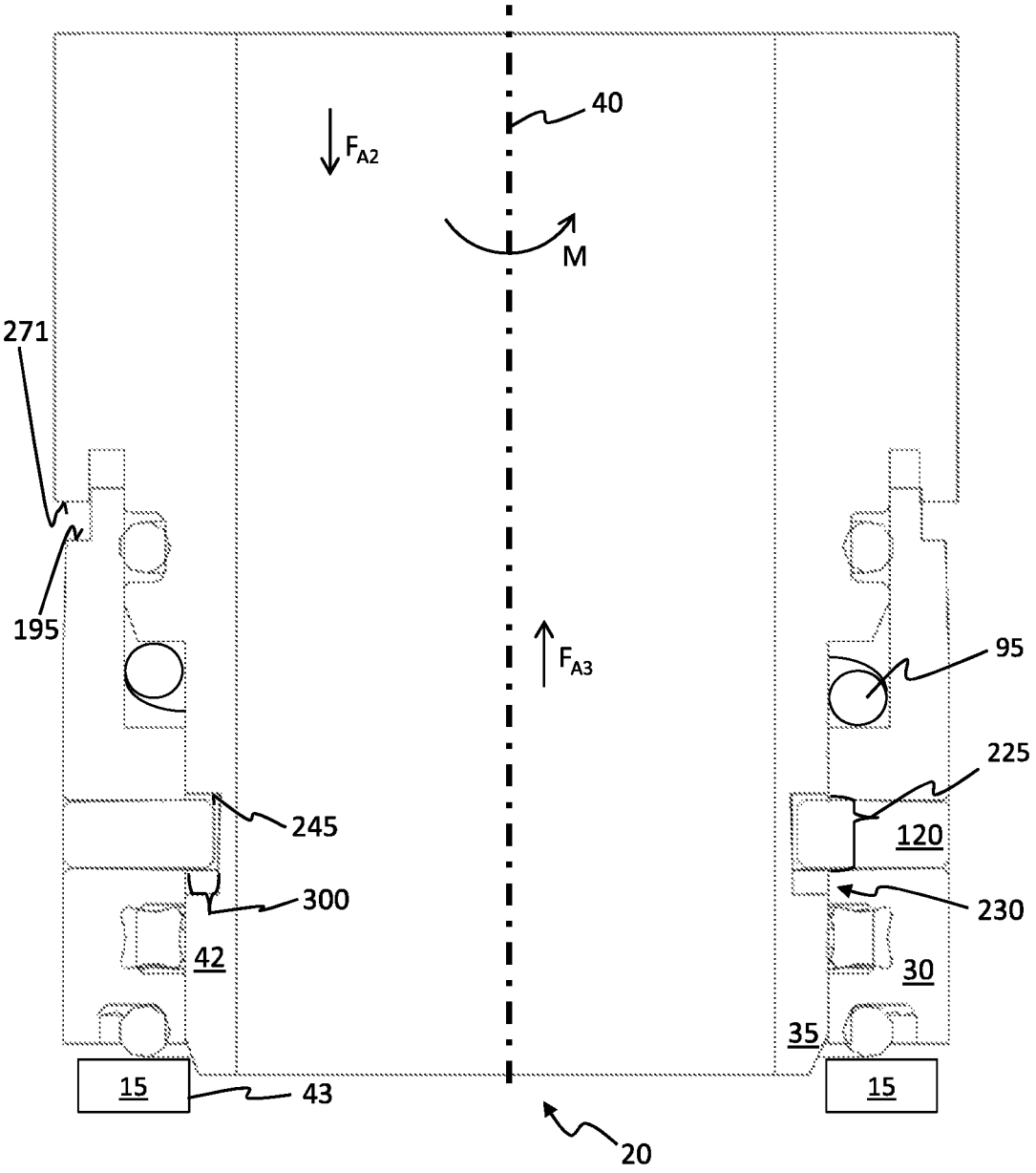
FIG. 8 depicts a sectional view along the sectional plane A-A depicted in FIG. 1 cutting through the first contact device shown in FIG. 1, wherein the first contact housing is in a second axial position with regard to the base.

FIG. 8 shows a sectional view along the sectional plane A-A shown in FIG. 1 through the first contact device 20 shown in FIG. 1, wherein the first contact housing 35 is arranged in a second axial position.

In the second axial position, the first contact housing 35 is shifted downwards in the direction of the component housing 15 compared to the first axial position shown in FIG. 7. In the second axial position, the locking pin 120 does not engage with the face spline 230, but engages with the unlocking section 225. The unlocking section 225 is embodied as a ring-shaped circumferential groove so that in the circumferential direction a movement of the first contact housing 35 relative to the base 30 around the rotational axis 40 and the second axial position is enabled and thereby e.g. the first housing section may be aligned in such a way that the connecting line or at least the second contact device and the first housing section are aligned in a flush manner with regard to each other. Furthermore, the second housing section 42 protrudes into the via opening 43.

The unlocking of the locking device 90 in order to transfer the first contact housing 35 from the first axial position into the second axial position may be carried out according to two possibilities.

For the first possibility, a user of the system may press onto a top side of the first contact housing 35 with a second axial force $F_{A2}$, wherein by the second axial force $F_{A2}$ the first contact housing is transferred from the first axial position (cf. FIG. 7) into the second axial position (cf. FIG. 8) in a relative manner with regard to the base 30 against the effect of the clamping device 95, until the locking pin 120 exclusively engages with the unlocking section 225 and is thus arranged outside of the face spline 225. If the second axial force $F_{A2}$ is maintained, the first contact housing 35 may be pivoted around the rotational axis 40 relative to the base 30.

The axial shift of the first contact housing 35 with regard to the base 30 is delimited in the embodiment by the second pin section 300 abutting on the groove-side face 235 on a side facing away from the face spline 230. Thereby, excessive pressing of the clamping device 90 is prevented.

As an alternative, the second step surface 271 may bump onto the first step surface 195, thus delimiting the movement of the first contact housing 35 in the direction of the base 30 or, respectively, of the component housing 15.

The clamping device 95 is tensioned in the second axial position and provides a third axial force $F_{A3}$ acting against the second axial force $F_{A2}$. If the second axial force $F_{A2}$ is cancelled after rotating the first contact housing 35, the third axial force $F_{A3}$ conveys the first contact housing 35 back from the second axial position to the first axial position. Thereby, the second pin section clicks into place between two teeth.

In a second variant, the user exclusively introduces a torque M into the first contact device 20 for rotating the first contact housing 35 with regard to the base 30. Due to the slanted alignment of the first tooth flank 320 and the contact surface 345 abutting according to the first tooth flank 320, the torque M provides a transfer of a part of the torque M into the second axial force $F_{A2}$. Thereby, the second axial force $F_{A2}$ counteracts the third axial force $F_{A3}$, wherein, if the second axial force $F_{A2}$ is larger than the third axial force $F_{A3}$, the first tooth flank glides along the contact surface 345 of the locking pin 120 during rotation of the first contact housing 35. The face spline 230 or, respectively, the first contact housing 35 is in this context shifted in the direction of the component housing 15 from the first axial position to the second axial position due to the second axial force $F_{A2}$. If the second pin section 300 glides over the tooth tip, the first contact housing 35 is in the second axial position.

In a further rotation, the second pin section 300 glides along the second tooth flank, wherein the clamping device guides the first contact housing 35 back into the first axial position by the second axial force $F_{A2}$, until the second pin section 300 is centrally arranged between the teeth. If the torque M is further maintained, the described clicking axial movement is repeated between the first axial position and the second axial position until the first contact section branches off into the desired direction. The two first lines are twisted within the first contact housing 35.

Moreover, the first contact device 20 may comprise a torsion protection that is embodied to only allow rotation of the first contact housing 35 around a predefined further angle, e.g. 350°, around the rotational axis 40 with regard to the base 30. This ensures that the first electrical line is not too heavily twisted in the first contact device 20.

This second variant has the advantage that a haptic experience during rotation of the first contact device 20 is additionally provided to the user by which the user is alerted to the locking of the locking pin 120 after providing the torque M between the teeth. Furthermore, the first contact housing 35 may also be rotated around the rotational axis in small installation spaces.

Figure 9:
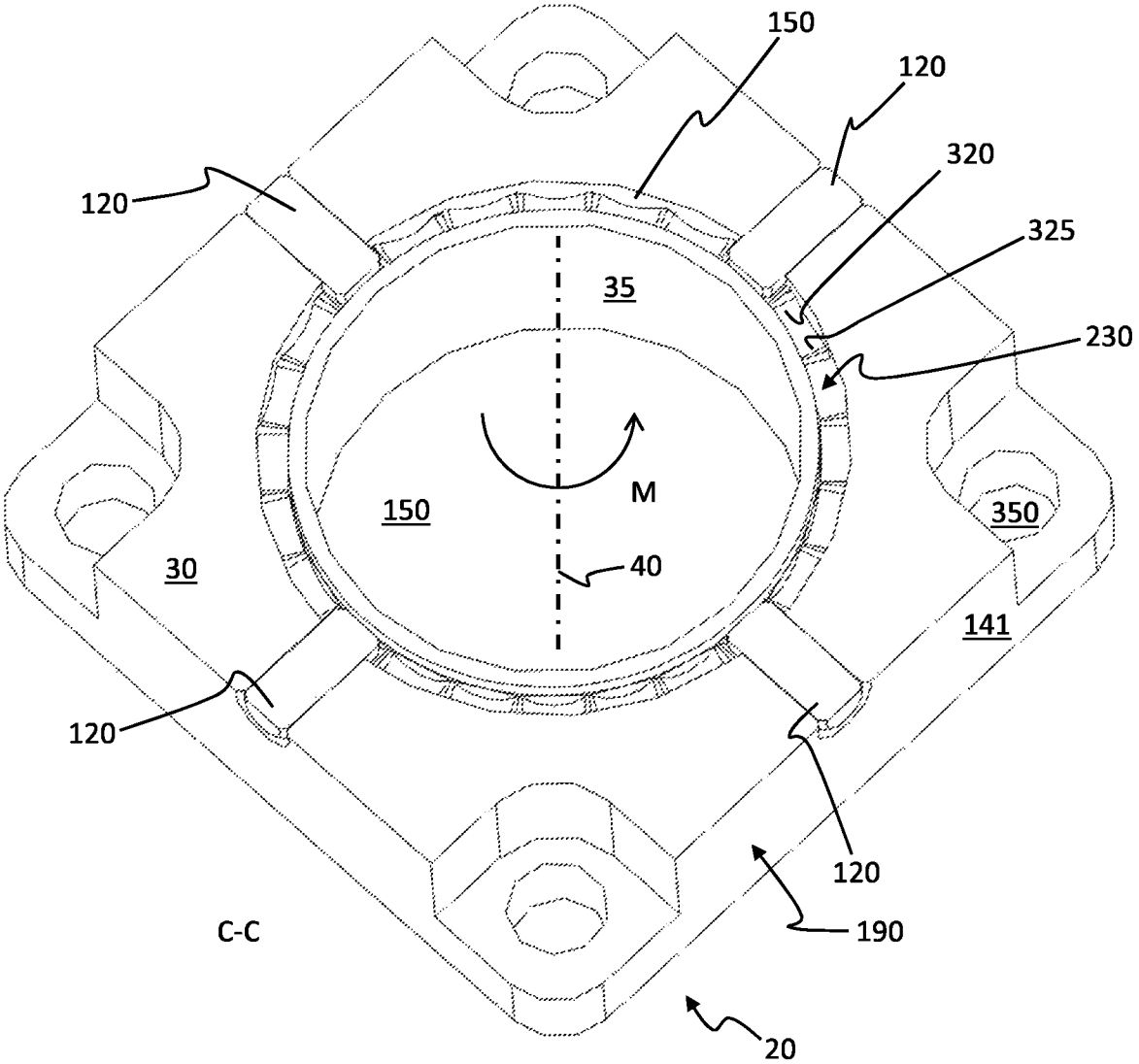
FIG. 9 shows a sectional view along a sectional plane C-C shown in FIG. 1 cutting through the first contact device depicted in FIG. 1.

FIG. 9 shows a sectional view along a sectional plane C-C shown in FIG. 1 through the first contact device 20 depicted in FIG. 1.

The face spline 230 comprises a tooth pitch that is selected in such a way that in the first axial position all locking pins 120 engage with the face spline 230. Moreover, even if the torque M around the rotational axis 40 is introduced into the first contact housing 35, it is prevented that only one tooth flank 320, 325 of the face spline 230 is constantly strained and the other tooth flanks 320, 325 of the face spline 230 remain unstrained. This ensures uniform wear of the face spline 230 as well as of the locking pin 120.

The uniformly chosen distance between the two locking pins 120 in the circumferential direction, wherein the locking pins 120 are arranged at an 90° angle with regard to each other in the embodiment, moreover ensures that when the first contact housing 35 is transferred from the first to the second axial position and from the second back to the first axial position, the first contact housing 35 does not tilt in the base interior 150 and/or at least one of the radial bearings is not overstressed.

In addition, a fastening aperture 350 may be provided laterally at the outer circumferential base side 190 in a corner area of the first base section 141 in order to fasten the base 30 to the component housing in a releasable manner and to press the first sealing element against the side face by a fastener, e.g. a screw connection.

Figure 10:
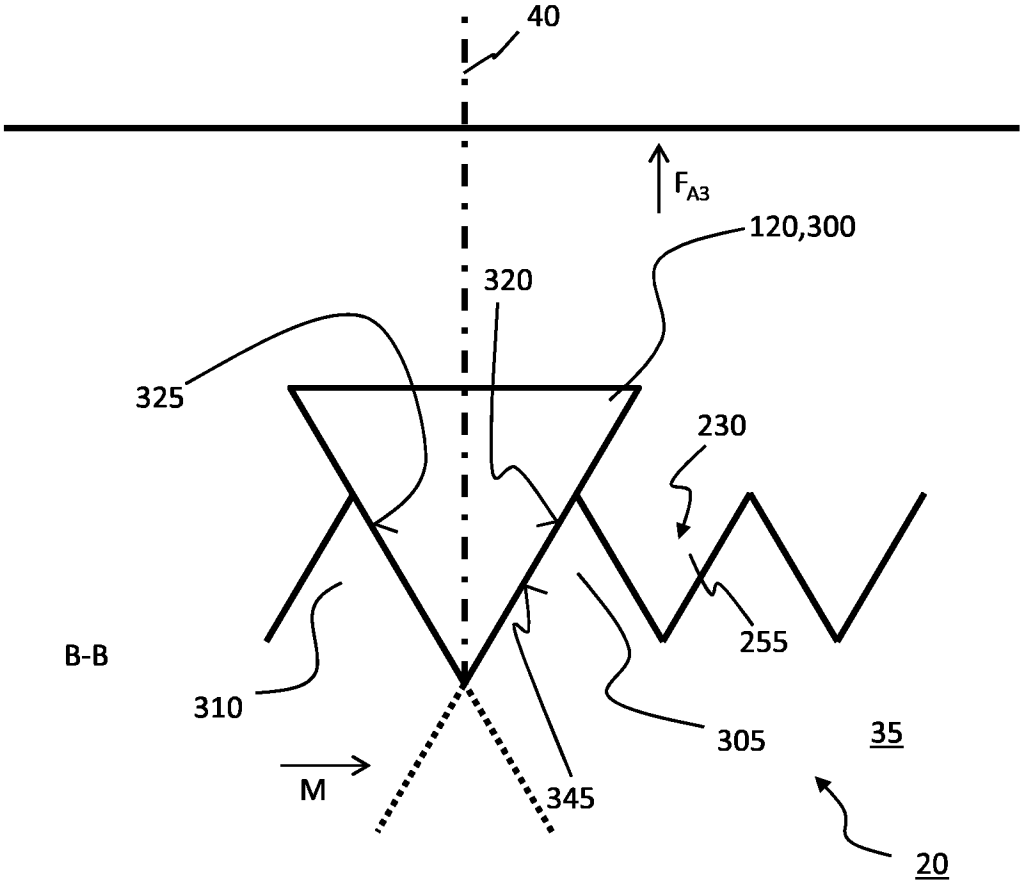
FIG. 10 shows a detail of a sectional view along the sectional plane B-B depicted in FIG. 1 running through a first contact device according to a second embodiment.

FIG. 10 shows a detail of a sectional view along the sectional plane B-B shown in FIG. 1 according to a first embodiment through a first contact device 20 according to a second embodiment.

Unless otherwise described, the first contact device 20 is essentially identical to the first contact device shown in FIGS. 1 to 9.

The first tooth flank 320 axially bumps on the second tooth flank 325 on a side facing away from the unlocking section 225 of the teeth 305, 310. The tooth 305, 310 exemplarily comprises a triangular cross-section. The tooth flank 320, 325 and the respectively corresponding contact surface 345 are each arranged in a plane extending in a slanted manner with regard to the plane in which the rotational axis extends. The tooth flank 320, 325 and the contact surface 345 are each embodied in accordance to each other and embodied in a plane manner in the embodiment.

At least in the second pin section 300, the locking pin 120 has a triangular, preferably an isosceles triangular cross section.

Figure 11:
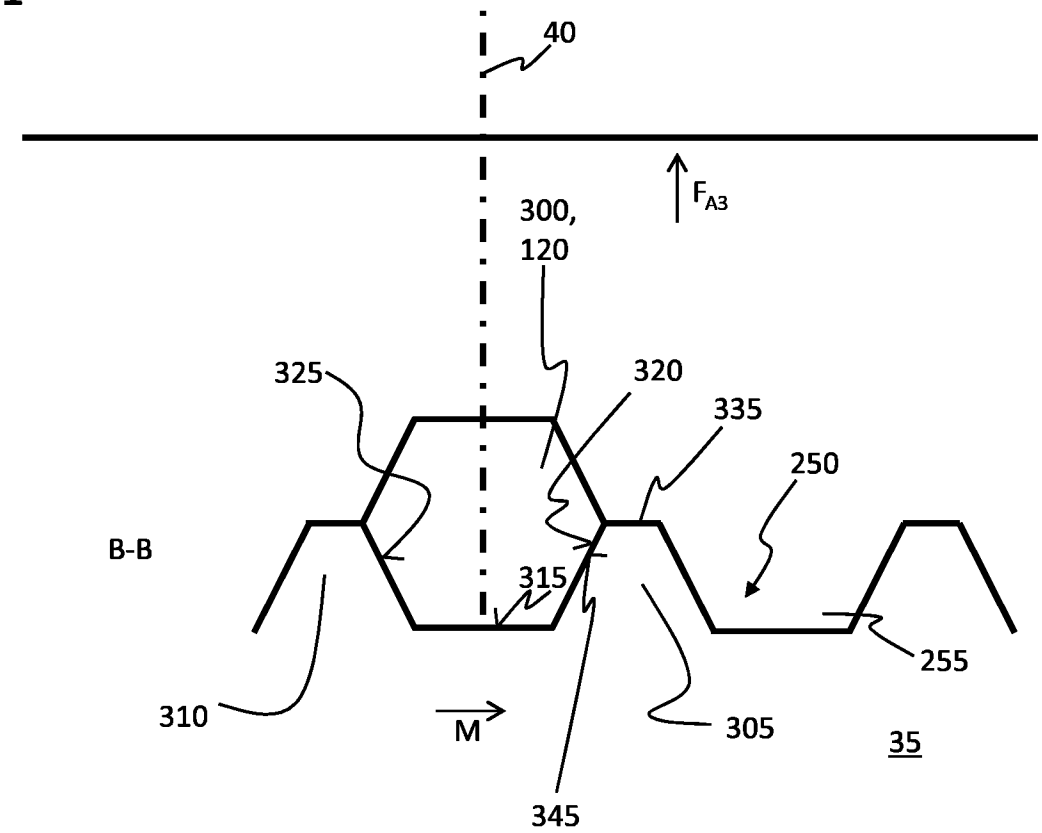
FIG. 11 depicts a sectional view along a sectional plane shown in FIG. 1 through a first contact device according to a third embodiment.

FIG. 11 depicts a section view along the sectional plane B-B shown in FIG. 1 through a first contact device 20 according to a third embodiment.

The first contact device 20 is essentially a combination of the first contact device shown in FIG. 10 and in FIGS. 1 to 9.

In the embodiment, the locking pin 120 is exemplarily embodied as a polygon at least in the second pin section 300. The polygon-shaped cross-section may also extend over the entire extension of the locking pin 120. In this case, of course, the recess with which the first pin section engages, too, would have a polygon shape corresponding to the polygonal embodiment of the locking pin 120. The face spline 230 is embodied such that the tooth tip 335 is embodied in a plane manner in order to delimit the unlocking section 225, and extends in a rotational plane with regard to the rotational axis 40.

In the embodiment, the tooth flanks 320, 325 as well as the contact surface 345 provided in accordance to the tooth flank 320, 325 are embodied in a plane manner. The tooth flanks 320, 325, too, may have a convex or concave embodiment and the accordingly associated contact surface 345 may have a concave or convex embodiment.

Between the two teeth 305, 310, the bottom land 315 is provided, as already described in FIGS. 1 to 9. In the first axial position of the third embodiment, the second pin section 300 abuts on the bottom land 315 with the contact surface 345 as well as on the tooth flanks 320, 325. It is also contemplated that the bottom land 315 is arranged at a distance to the contact surface 345.

Due to the polygonal embodiment, a uniform continuous axial movement for transferring the first contact housing 35 from the first to the second axial position is ensured when introducing the torque M into the contact housing 35, as is the case in FIG. 10.

This invention has been described with respect to exemplary embodiments. It is understood that changes can be made and equivalents can be substituted to adapt these disclosures to different materials and situations, while remaining with the scope of invention. The invention is thus not limited to the particular examples that are disclosed, but encompasses all the embodiments that fall within the scope of the claims.

REFERENCE LIST

| | |
|---|---|
| 10 | system |
| 15 | component housing |
| 20 | first contact device |
| 25 | connecting line |
| 30 | base |
| 35 | first contact housing |
| 36 | fastener |
| 37 | side face |
| 40 | rotational axis |
| 41 | first housing section |
| 42 | second housing section |
| 43 | via opening |
| 44 | housing interior |
| 45 | connecting face |
| 46 | counter plug |
| 50 | first contact element |
| 55 | first electrical line |
| 60 | second contact device |
| 61 | second contact housing |
| 65 | second electrical line |
| 70 | second contact element |
| 90 | locking device |
| 95 | clamping device |
| 96 | corrugated spring |
| 100 | sealing device |
| 105 | first sealing element |
| 110 | second sealing element |
| 115 | third sealing element |
| 120 | locking pin |
| 125 | lower base-front face |
| 130 | upper base-front face |
| 141 | first base section |
| 142 | second base section |
| 143 | third base section |
| 145 | first sealing groove |
| 150 | base interior |
| 151 | environment |
| 155 | inner circumferential base face of the base |
| 160 | second sealing groove |
| 165 | first radial-bearing surface |
| 170 | first radial bearing |
| 175 | first recess |
| 176 | longitudinal axis of recess |
| 180 | first step |
| 181 | first supporting surface |
| 185 | first chamfer |
| 190 | outer circumferential base face of the base |
| 194 | second step |
| 195 | first step surface |
| 200 | outer circumferential housing face (of the first contact housing) |
| 205 | lower housing-front face (of first contact housing) |
| 210 | second chamfer |

-continued

| REFERENCE LIST | |
|---|---|
| 215 | second radial-bearing surface |
| 220 | locking structure |
| 225 | unlocking section |
| 230 | face spline |
| 235 | groove side face |
| 240 | groove root surface |
| 245 | third step |
| 246 | second supporting surface |
| 250 | third chamfer |
| 255 | third radial-bearing face |
| 260 | second radial bearing |
| 265 | third sealing groove |
| 270 | fourth step |
| 271 | second step surface |
| 275 | second recess |
| 276 | fourth radial-bearing surface of second radial bearing |
| 280 | third radial bearing |
| 285 | fifth radial-bearing surface |
| 290 | sixth radial-bearing surface |
| 291 | spring chamber |
| 295 | first pin section |
| 300 | second pin section |
| 305 | first tooth |
| 310 | second tooth |
| 315 | bottom land |
| 320 | first tooth flank |
| 325 | second tooth flank |
| 330 | center point |
| 335 | tooth tip |
| 340 | tooth root |
| 345 | contact surface |
| 350 | fastening aperture |

The invention claimed is:

1. A contact device, comprising:

a contact housing, a base and a locking device, the base delimiting a base interior, the contact housing engaging with the base interior at least in sections, the locking device comprising a locking structure at an outer circumferential housing face of the contact housing and at least a locking pin, the locking structure having a face spline and an unlocking section abutting on the face spline in an axial direction, the unlocking section is embodied in the shape of a groove and extending around the contact housing in the circumferential direction at least in sections, the locking pin being connected to the base and protruding into the base interior, the contact housing being shiftable relative to the base between a first axial position and a second axial position in an axial direction, the locking pin engaging with the face spline in the first axial position and securing a position of the contact housing relative to the base in the circumferential direction, and wherein in the second axial position, the locking pin engages with the unlocking section and the contact housing is rotatable around a rotational axis relative to the base in the circumferential direction.

2. The contact device according to claim 1, the face spline comprising at least a first tooth and a second tooth, the first tooth being arranged at a distance with regard to the second tooth in the circumferential direction, the face spline comprising a bottom land between the teeth, the locking pin comprising a pin section, the pin section being arranged in the base interior and comprising contact surface at a circumferential side on a side facing the face spline, and the contact surface abutting at least in sections on the bottom land in a first axial position, or the contact surface being arranged at a distance to the bottom land in a first axial position.

3. The contact device according to claim 2, the first tooth having a tooth tip and a tooth root, the unlocking section being delimited by the tooth tip in an axial direction at a first axial side and the tooth root being arranged on a side of the first tooth facing away from the unlocking section, and the unlocking section being delimited by a groove side face at a second axial side opposite to the first axial side in an axial direction.

4. The contact device according to claim 3, wherein the groove side face is arranged in a first rotational plane of the rotational axis.

5. The contact device according to claim 2, wherein the contact surface of the pin section has a cross-section that is at least in sections embodied in an arch-shape and/or as a plane and/or in a polygon shape and/or in a concave manner and/or in a convex manner.

6. The contact device according to claim 2, wherein the second tooth comprises a second tooth flank on a side facing the first tooth, and wherein the contact surface abuts on the first tooth flank and on the second tooth flank in the first axial position.

7. The contact device according to claim 6, wherein the first tooth flank, the bottom land and the second tooth flank are arranged on a shared arch, in particular on a shared circular path having a center point, and wherein the center point is arranged in the unlocking section, or wherein the center point is arranged outside of the unlocking section.

8. The contact device according to claim 7, wherein the center point is arranged on a side of the locking section facing away from the face spline.

9. The contact device of claim 6, wherein the first tooth flank and the second tooth flank are arranged in parallel to each other; or wherein the first tooth flank has an angle ($\alpha$) with regard to the second tooth flank, and wherein the angle ($\alpha$) is a blunt or an acute angle; or wherein the first tooth flank has an angle ($\alpha$) with regard to the second tooth flank, and wherein the angle ($\alpha$) is in a range of 0° to 170°; or wherein the first tooth flank has an angle ($\alpha$) with regard to the second tooth flank, and wherein the angle ($\alpha$) is in a range of 30° to 90°; or wherein the first tooth flank has an angle ($\alpha$) with regard to the second tooth flank, and wherein the angle is 60°.

10. The contact device according to claim 1, the face spline comprising at least a first tooth having a first tooth flank, the locking pin comprising a pin section, the pin section being arranged in the base interior and comprising a contact surface in the circumferential direction on a side facing the face spline, the first tooth flank being aligned at least in sections in a slanted manner with regard to a plane in which the rotational axis extends, or the first tooth flank and the rotational axis being aligned in parallel to each other, and the contact surface abutting on the first tooth flank in the first axial position.

11. The contact device according to claim 10, the first tooth flank being aligned in such a way that in interaction with the contact surface when the contact housing is rotated relative to the base around the rotational axis due to a shifting movement of the first tooth flank at the contact surface, an axial shift of the contact housing takes place from the first axial position to the second axial position.

12. The contact device of claim 1, further comprising a clamping device, wherein the clamping device is arranged between the base and the contact housing in the base interior, wherein the contact housing is configured to be shifted from the first axial position into the second axial position counteracting the effect of the clamping device, and wherein in the second axial position the clamping device provides an axial force ($F_{A3}$) for guiding the contact housing back into the first axial position.

13. The contact device of claim 12, wherein the clamping device is untensioned in the first axial position, or wherein the clamping device is pre-tensioned in the first axial position and presses the face spline against the contact surface by a further axial force ($F_{A1}$).

14. The contact device according to claim 12, wherein the clamping device comprises at least a disc spring and/or an corrugated spring and/or a pressure spring, wherein the base comprises a first step on a side facing the base interior and the contact housing comprises a second step on its radial outer side, wherein the clamping device is axially arranged between the first step and the second step, and wherein at one side, the clamping device is supported by the first step and on the other side by the second step.

15. The contact device according to claim 1, wherein the base comprises at least one recess, wherein the recess is arranged in an inclined manner with regard to the rotational axis, or in second rotational plane with regard to the rotational axis, wherein the locking pin comprises a further pin section, and wherein the further pin section engages with the recess at least in a section-wise manner, wherein the further pin section is connected to the base in a force-locking and/or in a form-locking and/or in a material-locking manner, or wherein the further pin section is press-fitted in the recess.

16. The contact device according to claim 1, further comprising a first radial bearing, wherein the first radial bearing comprises, axially between a lower base-front face and the locking pin, a first radial-bearing surface at an inner circumferential base side of the base, wherein the first radial bearing at the outer housing circumferential side of the contact housing comprises a second radial-bearing surface correspondingly embodied to the first radial-bearing surface axially between a lower housing-front face of the contact housing and the locking structure, and wherein the first radial-bearing surface and the second radial-bearing surface are embodied extending circularly around the rotational axis, and/or wherein the second radial-bearing surface is supported by the first radial-bearing surface.

17. The contact device according to claim 16, further comprising a second radial bearing, wherein the second radial bearing is arranged axially opposite to the first radial bearing, wherein the second radial bearing comprises a third radial-bearing surface at the outer circumferential housing side of the contact housing, wherein the second radial bearing comprises a fourth radial bearing surface arranged in an axial manner between an upper base-front face opposite to the lower base-front face and the locking pin at the inner circumferential base side of the base, wherein the third radial-bearing surface and the fourth radial-bearing surface are embodied extending around the rotational axis, and wherein the third radial-bearing surface is supported by the fourth radial-bearing surface, and/or wherein the first radial bearing is embodied in a narrower manner in a radial direction than the second radial bearing.

18. The contact device according to claim 16, further comprising a sealing device having at least one sealing element, wherein the sealing element is arranged axially between the locking pin and the lower base-front face, wherein the sealing element is arranged in a radial direction between the base and the contact housing, and wherein the sealing element seals off the base interior against fluids from an environment.

19. The contact device according to claim 18, wherein the sealing element has an x-shaped cross-section or is embodied as an O-ring.

20. The contact device according to claim 1, wherein the contact housing comprises a first housing section and a second housing section connected to the first housing section, wherein the second housing section is at least partially arranged in the base interior and the first housing section is arranged outside of the base interior, wherein the first housing section is arranged in an inclined manner or perpendicular, with regard to the second housing section, and wherein the first housing section and the second housing section are connected by a form-fit and/or a material-fit and/or by a force-fit, or wherein the first housing section and the second housing section are embodied integrally and in one material piece.

* * * * *